United States Patent [19]

Tuchiya et al.

[11] 4,168,594

[45] Sep. 25, 1979

[54] REMOTE CONTROLLER FOR HINGED WINDOW

[75] Inventors: Yoshimasa Tuchiya, Sayama; Hiroshi Imai, Kodaira, both of Japan

[73] Assignees: Nissan Motor Company, Limited, Yokohama; Johnan Seisakusho Company, Limited, Ueda, both of Japan

[21] Appl. No.: 878,808

[22] Filed: Feb. 17, 1978

[30] Foreign Application Priority Data

Feb. 17, 1977 [JP] Japan ..... 52/18128[U]

[51] Int. Cl.[2] ..... E05F 11/00

[52] U.S. Cl. ..... 49/325; 49/354; 49/356

[58] Field of Search ..... 49/325, 354, 356, 357, 49/348, 352, 353

[56] References Cited

U.S. PATENT DOCUMENTS

| | | | |
|---|---|---|---|
| 1,301,975 | 4/1919 | Root | 49/356 X |
| 1,496,934 | 6/1924 | Holtz | 49/354 X |
| 1,997,646 | 4/1935 | Miller | 49/352 X |
| 3,235,248 | 2/1966 | Golde | 49/352 X |
| 3,280,509 | 10/1966 | Werner | 49/352 |

FOREIGN PATENT DOCUMENTS

| | | | |
|---|---|---|---|
| 150076 | 2/1953 | Australia | 49/325 |
| 21586 | 5/1928 | Netherlands | 49/325 |
| 1052760 | 12/1966 | United Kingdom | 49/325 |

*Primary Examiner*—Philip C. Kannan

[57] ABSTRACT

A remote controller for remotely controlling the opening position of a hinged window of a vehicle, which comprises a flexible cable with one end operatively connected to a free end portion of the window, a cable guide member for guiding the cable, an operating device connected to the cable to longitudinally move the same causing opening and closing movements of the window when operated, and a one-way braking mechanism for braking the longitudinal movements of said cable induced by the opening and closing movements of the window while freely permitting the movements of the cable via the operation of the operating device.

9 Claims, 11 Drawing Figures

REMOTE CONTROLLER FOR HINGED WINDOW

FIELD OF THE INVENTION

The present invention relates in general to a vehicular window controller and more particularly to a remote controller by which the opening and closing movements of a hinged window of the vehicle are remotely controlled by a passenger who is seated away from the window.

BACKGROUND OF THE INVENTION

Most of two-door type passenger vehicles are equipped behind the side doors with side windows each of which is hinged at its front edge to a suitable pillar such as a center pillar to be laterally swingably openable. Hitherto, the setting of such window at its desired opening and/or closing position has been achieved by using a conventional toggle link which has jointed two bars respectively connected at their leading ends to a free end portion of the window and the vehicle body. Although this toggle link is advantageous in providing tight setting of the window at the fully open position and at the fully closed position, it is impossible to tightly set the window at a desired partly open position. Furthermore, such link is disadvantageous in that the opening and closing operations of the window have to be made by a passenger who is seated just near the window. In other words, the operation of such window cannot be made by the driver who is positioned away from the window.

SUMMARY OF THE INVENTION

Therefore, the present invention contemplates to eliminate the drawbacks encountered in the prior art window controller mentioned above.

It is an object of the present invention to provide a controller by which the desired opening position of the vehicular hinged window is assuredly set.

It is another object of the present invention to provide a controller by which the opening and closing movements of the hinged window can be remotely controlled by a passenger of the vehicle who is seated away from the window.

It is still another object of the present invention to provide a hinged window remote controller which is simple in construction.

BRIEF DESCRIPTION OF THE DRAWINGS

Other objects and advantages of the present invention will become apparent from the following detailed description when taken in conjunction with the accompanying drawings, in which.

DESCRIPTION OF THE PREFERRED EMBODIMENTS

Figure 1:
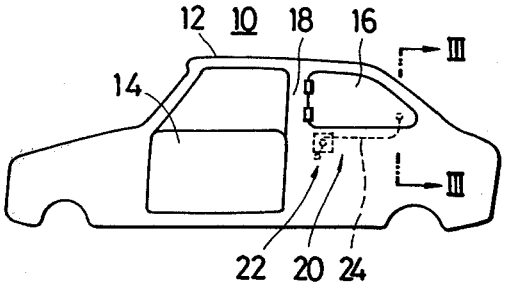
FIG. 1 is a sketch of a two-door type passenger vehicle having at each side thereof a hinged side window to which a remote controller of the present invention is connected.

Referring to FIG. 1, there is shown a two-door type passenger vehicle 10 having a body 12, a door 14 at each side of the body 12, and a side window 16 at each side of the body 12 behind the door 14. The side window 16 is hinged at its front end to a center pillar 18 so that the window 16 is pivotable about the center pillar 18 to open and close. A remote controller according to the invention, generally designated by numeral 20, is arranged below the side window 16 to remotely control the opening and closing movements of the side window 16. The remote controller 20 generally comprises an operating device 22 set in an advantageous position where a passenger seated in the front, such as a vehicle driver, can easily operate the operating device 22, and a motion transmitting device 24 located rearward of the operating device 22 to transmit a motion given by the operating device 22 to the side window 16 to open and close the same.

Figure 2:
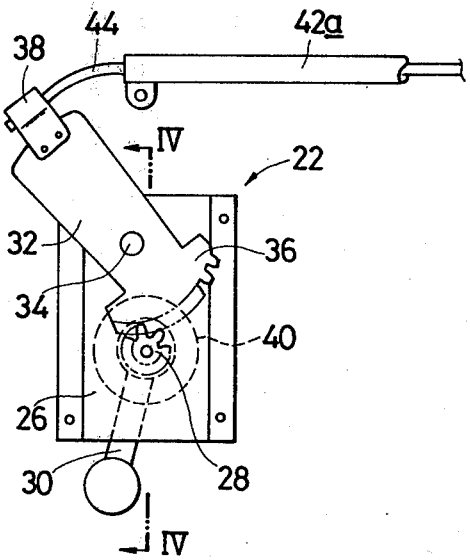
FIG. 2 is a sketch of an operating device employed in the remote controller of the invention.

FIG. 2 shows schematically the operating device 22 of the remote controller 20. The device 22 generally comprises a base plate 26 fixed to an inner panel (D) via bolts (not shown), a pinion 28 on a shaft rotatably fixed to the base plate 26, a handle 30 connected to the shaft to rotate the pinion 28 when rotated or cranked by a passenger of the vehicle 10. An arm 32 is pivotally supported by a shaft 34 fixed to the base plate 26 and is formed at its lower section with a sector gear portion 36 meshed with the pinion 28. The arm 32 is provided at its upper section with a connector 38. The connector 38 grasps a flexible cable or wire 44 which constitutes a part of the motion transmitting device 24. Indicated by a dotted line 40 is a one-way braking mechanism which is also a part of the operating device 22. As will be well understood hereinlater, the one-way braking mechanism 40 functions to brake the movement of the arm 32 induced by the opening and closing movements of the hinged side window 16, but freely permit the movement of the side window 16 via the rotation of the handle 30.

For facilitation, the detailed description of the one-way braking mechanism 40 will be made later.

Figure 3:
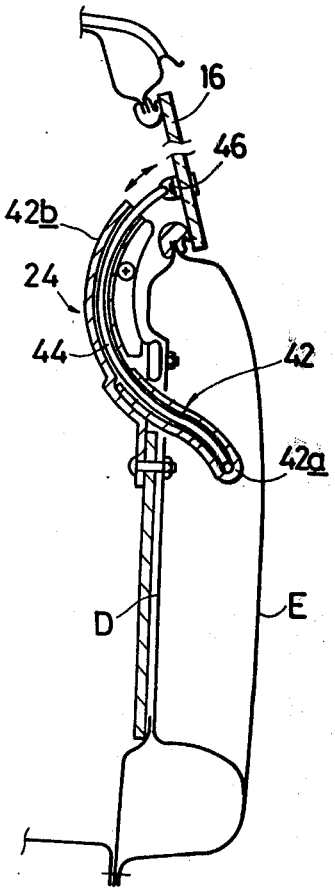
FIG. 3 is a sectional view taken along the line III—III of FIG. 1, showing a connecting manner between a free end portion of the hinged side window and a cable leading from the operating device of FIG. 2.

In FIG. 3, the motion transmitting device 24 is sectionally illustrated as cooperating with the hinged side window 16. The device 24 comprises a tubular guide member 42 which is composed of a generally straight section **42*a* (FIG. 2) longitudinally disposed in a space defined by the inner panel D and an outer panel E, and a curved section 42*b* protruding into the passenger compartment of the vehicle 10. The end of the straight section 42*a* is positioned adjacent the pivotable arm 32 as seen in FIG. 2, and the end of the curved section 42*b* is located to face toward the free end of the hinged side window 16 as viewed in FIG. 3. Longitudinally slidably disposed in the tubular guide member 42 is the flexible cable or wire 44** mentioned above. An end of the cable 44 is grasped by the connector 38 and the other end of it is connected to the free end of the window 16 via a conventional connector 46. Preferably, the end of the curved section 42*b* of the guide member 42 is arranged to permit the protruding end of the cable 44 to be perpendicular to the plane of the window 16 in closed position for the reason which will be apparent hereinlater.

Figure 4:
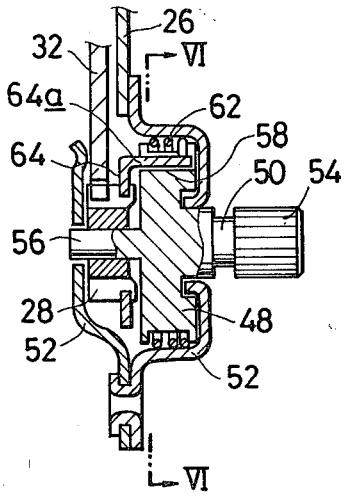
FIG. 4 is a sectional view taken along the line IV—IV of FIG. 2, showing a one-way braking mechanism employed in the operating device.
Figure 5:
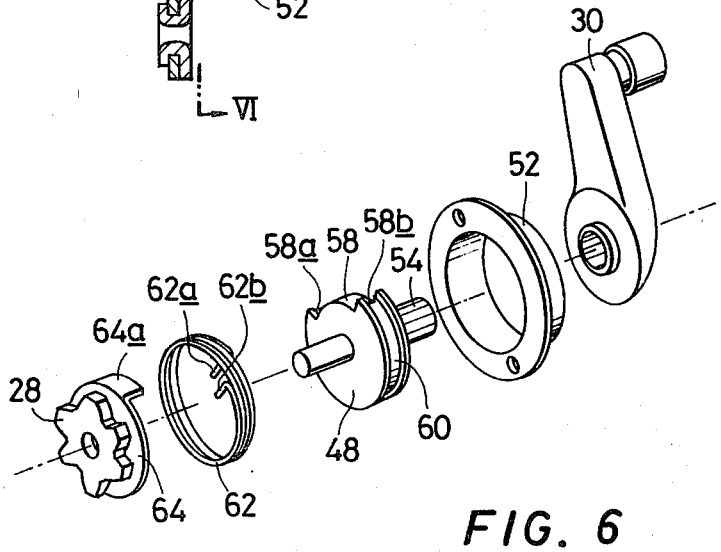
FIG. 5 is an exploded view of the one-way braking mechanism of FIG. 4.
Figure 6:
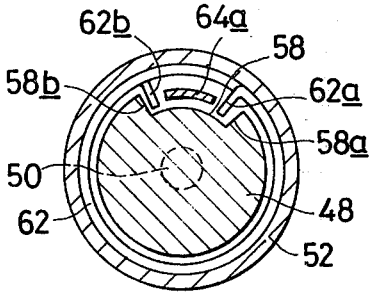
FIG. 6 is a sectional view taken along the line VI—VI of FIG. 4.

In FIGS. 4 to 6, a detailed construction of the one-way braking mechanism 40 is illustrated as constituting a part of the operating device 22. The braking mechanism 40 comprises a drum 48 integrally formed about the shaft 50 which is rotatably supported by the base plate 26 via a cylindrical housing 52. As best seen in FIG. 4, the shaft 50 has at one end an enlarged splined section 54 to which the handle 30 is fixed and at the other end a thin section 56 on which the pinion 28 is fixedly mounted. As well shown in FIG. 5, the drum 48 is formed at a peripheral section thereof with an arcuate recess 58 to define opposed wall sections 58*a* and 58*b*, furthermore, the drum 48 is formed around its periphery with an annular groove 60. A coil spring 62 with inwardly bent ends 62*a* and 62*b* is concentrically disposed in the annular groove 60 of the drum 48 in such a manner that the bent ends thereof are received in the arcuate recess 58 as best seen in FIG. 6. An annular plate 64 is coaxially connected to the pinion 28 to rotate therewith and is formed at a section of the periphery thereof with an axially extending small lug 64*a*. In assemblage, the lug 64*a* is positioned in the arcuate recess 58 of the drum 48 between the two bent ends 62*a* and 62*b* of the coil spring 62.

With this construction, the one-way braking mechanism 40 operates as follows:

When the handle 30 is rotated by a passenger in either direction, one wall section 58*a* or 58*b* of the arcuate recess 58 contacts the corresponding free end of the spring 62 to progressively cause a reduction in diameter, so that the rotation of the handle and thus that of the pinion 28 are smoothly or freely achieved. When, on the contrary, the pinion 28 is rotated or biased to rotate in either direction by any force other than that induced by the handle 30, the lug 64*a* of the annular plate 64 on the pinion 28 contacts the corresponding free end of the spring 62 to progressively cause an increase in diameter resulting in the periphery of the spring 62 being strongly and brakingly engaged with the inner surface of the cylindrical housing 52, so that the rotation of the pinion 28 is braked or suppressed.

The operation of the remote controller 20 of the invention is as follows:

When a passenger turns the handle 30 in either direction, the arm 32 meshed with the pinion 28 is rotated in the corresponding direction to push or pull the cable 44. With this, the flexible cable 44 longitudinally moves in the guide member 42 to protrude or draw its leading end from or into the guide member 42 to achieve the opening and closing movements of the side door 16. By the reason mentioned before, the operation of the handle 30 is smoothly and freely made under this operation. While, if the arm 32 is biased to rotate in either direction due to opening and closing movements of the side window 16 caused by some stress applied thereto, the movements are braked. Thus, the side window 16 can be kept in its desired opening or closing position even though any stress is suddenly applied thereto. It should be noted that since the leading end of the cable 44 is arranged to be perpendicular to the plane of the side window 16, the motion transmission of the cable 44 to the side window 16 is assuredly made without being accidentally bent.

Figure 7:
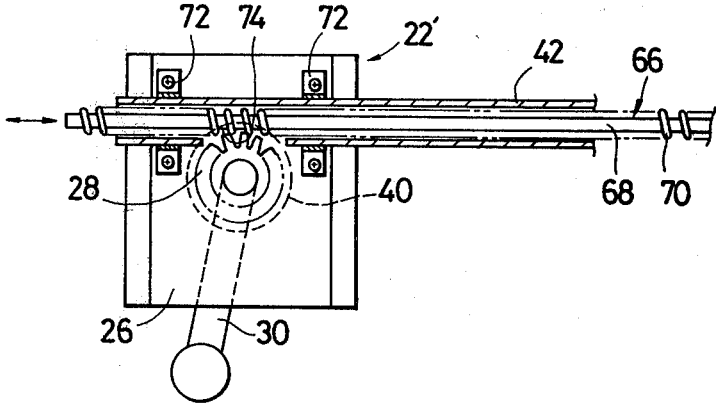
FIG. 7 is a sketch of an alternative operating device employable in a controller of the invention.

In FIG. 7, there is shown an alternative operating device 22' which is also employable in the remote controller of the invention. The same numerals indicate substantially the same parts as in the case of FIG. 2. The device 22' of this alternative case uses a flexible rack 66 for transmitting the motion of the handle 30 to the side window 16. As shown, the flexible rack 66 consists of a flexible cable 68 and spiral teeth 70 formed thereon and is longitudinally movably received in a tubular guide member 42. The guide member 42 is secured to the base plate 26 via connectors 72 and is formed with an elongate opening 74 through which the flexible rack 66 is in constant mesh with the pinion 28. In this case also, the one-way braking mechanism 40 is employed in the before mentioned manner. It will be thus appreciated that the cranking of the handle 30 induces the opening and closing movements of the side window 16 and the rotation of the pinion 28 induced by the movement of the side window 16 is braked.

Figure 8:
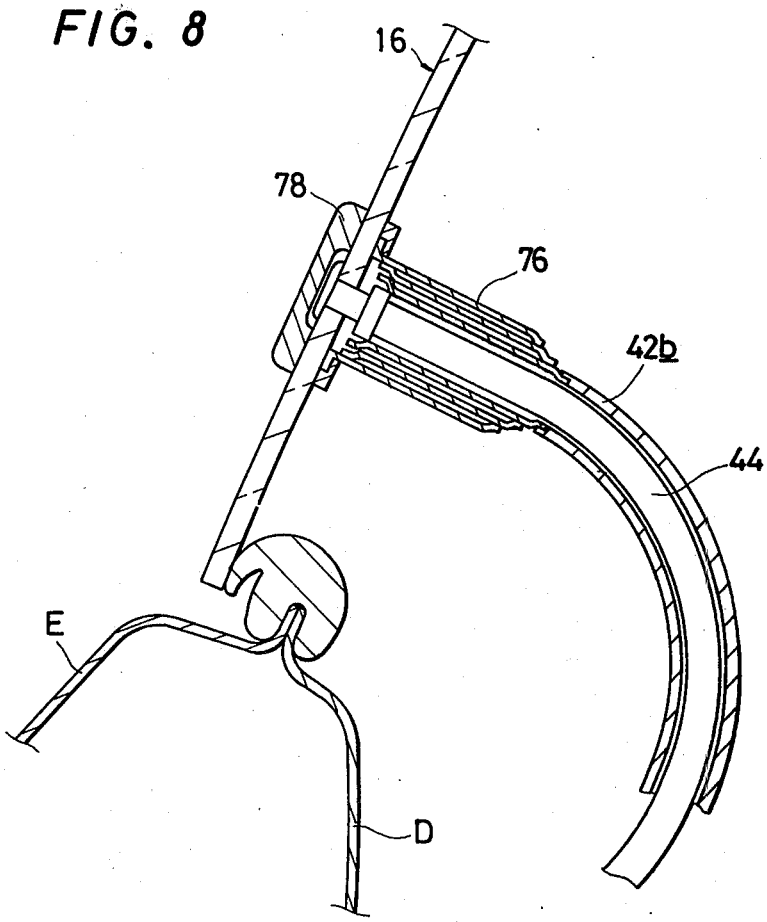
FIGS. 8, 9 and 10 are views similar to FIG. 3, but show other connecting methods between the hinged window and the cable.

FIG. 8 shows an example to more reliably transmit the longitudinal movements of the flexible cable 44 to the side window 16 by using a telescopic device 76 as a guide. An end of the telescopic device 76 is connected to the free end of the side window 16 via a connector 78 and the other end of the same is connected to the leading end of the curved section 42*b* of the tubular guide member 42. With this, the motion transmission of the flexible cable 44 to the side window 16 is achieved assuredly by the aid of the telescopic movements of the device 76.

Figure 9:
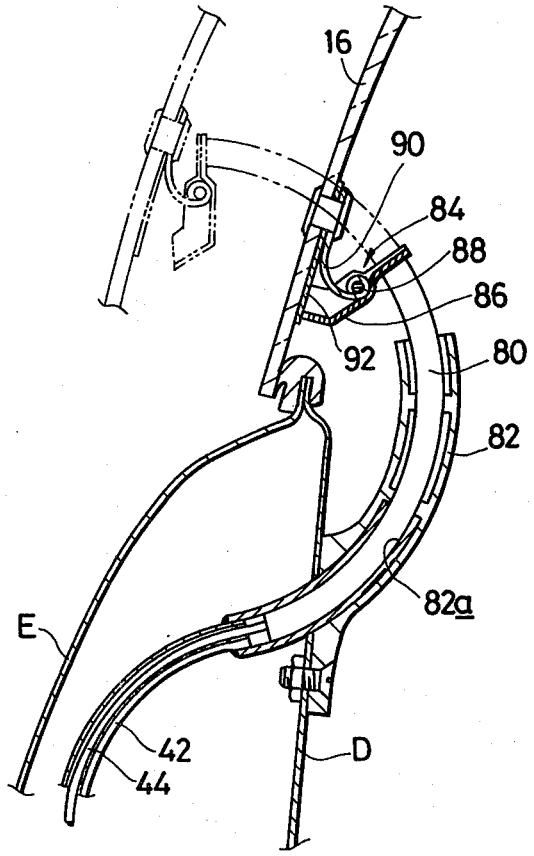

FIG. 9 shows another example to achieve the reliable motion transmission between the operating device 22 and the hinged side window 16. In this case, a rigid arcuate rod 80 is used, which is slidably received in a tubular guide member 82 which is also rigid and has a curved passage 82*a* having substantially the same configuration as the rod 80. If desired, the rod 80 may be constructed of a tubular member. As shown, an end of the rod 80 is connected via a specially designed connector 84 to the free end of the side window 16 and the other end of the same is connected to the flexible cable 44 leading from the operating device 22, the cable 44 being received in the tubular guide member 42. The connector 84 comprises a bracket 86 which is pivotally supported at its fulcrum 88 to a leaf spring 90 fixed to the free end of the side window 16. The bracket 86 has one side secured to the leading end of the rod 80 and another side which is contactable with a section of the side window 16 when the window 16 is closed as shown in a solid line. Designated by numeral 92 is a protector which may be made of rubber material or resin material and functions to prevent the direct engagement between the bracket 86 and the glass pane of the side window 16. The usage of the leaf spring 90 and the pivotable bracket 86 will complete the full opening and closing of the side window 16 due to the deformation and the rotation thereof. It should be noted that the assemblage of the rod 80 with the tubular guide member 82 is such made that even when the side window 16 is fully open, the arcuate rod 80 does not come out of the guide member 82.

Figure 10:
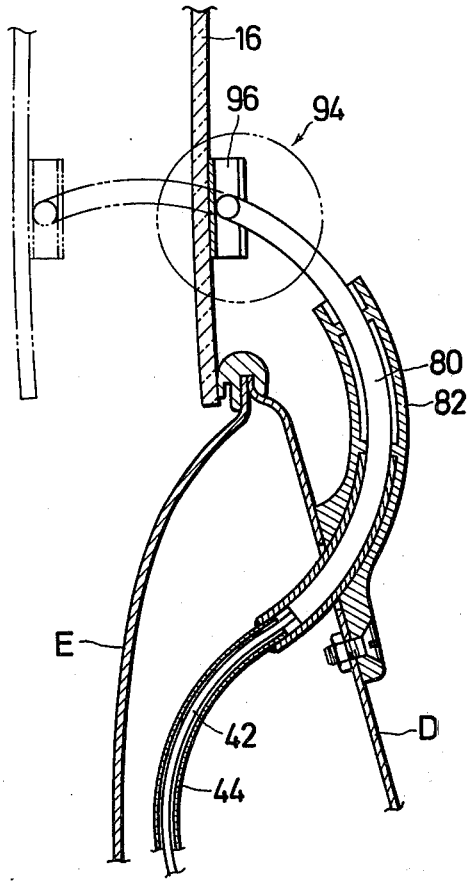
Figure 11:
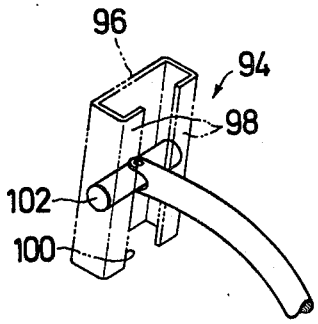
FIG. 11 is a perspective view of a part encircled in FIG. 10.

FIG. 10 shows still another example achieving the motion transmission between the operating device 22 and the hinged side window 16. As shown, the motion transmission device of this example comprises generally the same parts as in the case of FIG. 9, except for a connector 94 which transmits the motion of the arcuate rod 80 to the side window 16. For facilitation, the same parts are designated by the same numerals as in FIG. 9. A detailed construction of the connector 94 is illustrated in FIG. 11 in a perspective manner. The connector 94 includes a channel member 96 with a pair of flange portions 98 which extend toward each other from their corresponding side wall portions (no numerals), leaving an elongate opening 100 as shown. The channel member 96 is secured at its base wall to the free end of the side window 16. Longitudinally slidably received in the channel member 96 is a bar 102 to which a leading end of the arcuate rod 80 passing through the elongate opening 100 is connected. With the construction, the opening and closing movements of the side window 16 are reliable with sliding movements of the bar 102 in the channel member 96.

From the above, it will be appreciated that the opening and closing movements of the side window 16 can be remotely controlled in accordance with the present invention. More particularly, even if a passenger is seated away from the subject side window, he or she can easily open or close the window by only turning the handle located near him or her. Furthermore, the side window 16 can be kept in its desired opening or closing position due to the provision of the one-way braking mechanism in the actuating device 22.

In the proceeding description, it has been described that the remote controller 20 of the invention is used in the operation of the hinged rear side window, however, such controller 20 is also applied to other windows as long as they are hinged at one end.

The foregoing description shows only preferred embodiments of the present invention. Various modifications are apparent to those skilled in the art without departing from the scope of the invention which is only limited by the appended claims. Therefore, the embodiments shown and described are only illustrative, not restrictive.

What is claimed is:

1. A remote controller for remotely controlling the opening position of a hinged window of a vehicle having a body, comprising:

a motion transmitting device including a cable, a cable guide member fixed to said body for guiding the longitudinal movements of said cable, a rigid arcuate tube fixed to said body and having one end positioned adjacent a free end of said hinged window, a rigid arcuate rod longitudinally slidably received in said rigid arcuate tube and having one end connected to one end of said cable, and means for connecting the other end of said rigid arcuate rod with said free end of said hinged window;

an operating device fixed to said body for longitudinally moving said cable along the guide member to cause opening and closing of said hinged window when operated; and a one way braking mechanism incorporated with said operating device for braking the longitudinal movements of said cable induced by the opening and closing movements of said hinged window, while freely permitting the movements via the operation of the operating device.

2. A remote controller as claimed in claim 1, in which said cable guide member is a tube in which said cable is longitudinally slidably received.

3. A remote controller as claimed in claim 1, in which said means comprises:

a leaf spring fixed at its one end to the free end of said hinged window; and a bracket pivotally supported via a fulcrum by the other end of said leaf spring, the bracket having one end secured to a protruding end portion of said rigid arcuate rod.

4. A remote controller as claimed in claim 1, in which said means comprises:

a channel member having two flanges which extend toward each other from their corresponding side walls thereof leaving an elongate opening; and a bar slidably received in said channel member, said bar having a section to which a protruding end of said rigid arcuate rod is fixed.

5. A remote controller as claimed in claim 1, in which said operating device comprises:

a base plate attached to said body;

a shaft rotatably fixed to said base plate;

a handle connected to one end of said shaft;

a pinion connected to the other end of said shaft; and means for converting the rotational movement of said pinion to the longitudinal movement of said cable so that when said handle is rotated said cable moves to induce the opening and closing of said hinged window.

6. A remote controller as claimed in claim 5, in which said means comprises an arm pivotally connected to said base plate, said arm having one end connected to the other end of said cable and the other end formed into a sector gear meshed with said pinion, whereby said arm is gradually rotated about its fulcrum to longitudinally move said cable as the handle is rotated.

7. A remote controller as claimed in claim 5, in which said means comprises spiral teeth formed on said cable, said teeth being meshed with said pinion whereby when said handle is turned causing rotation of said pinion, said cable is longitudinally moved.

8. A remote controller as claimed in claim 5, in which said one-way braking mechanism comprises:

a drum coaxially disposed on said shaft, said drum being formed at a peripheral section with an arcuate recess;

a coil spring having both ends inwardly bent, said coil spring being coaxially disposed about said drum in a manner that said both ends are received in said arcuate recess;

an annular plate having an axially extending lug at a section of the periphery thereof, said annular plate being fixed to said pinion in a manner that said lug is received in said arcuate recess between said both ends of said spring;

a cylindrical housing fixed to said base plate and receiving therein a unit consisting of said drum and said coil spring, whereby when said handle is rotated in either direction, a wall section of said arcuate recess of said drum contacts the corresponding bent end of said coil spring to progressively cause a reduction in diameter, on the contrary, when the pinion and thus the annular plate are biased to rotate in response to the opening and closing movements of said hinged window, said lug of said annular plate contacts the corresponding bent end of said coil spring to progressively cause an increase in diameter resulting in that the periphery of said coil spring is brakingly engaged with an inner cylindrical wall surface of said cylindrical housing.

9. A remote controller for remotely controlling the opening position of a hinged window of a vehicle having a body, comprising:

a motion transmitting device including a cable having one end operatively connected to a free end of said hinged window, a cable guide member fixed to said body for guiding the movement of said cable, said cable guide member being a tube in which said cable is longitudinally slidably received, said tubular guide member having one end located adjacent the free end of said hinged window, the end of said tubular guide member being such arranged as to face a pane of said hinged window to allow said one end to extend perpendicularly to said pane of said hinged window in closed position, and a telescopically movable tubular device which is disposed about the end of said cable extruded from said end of said cable guide member, said telescopically movable tubular device having one end connected to said end of said tubular cable guide member and the other end connected to said free end of said hinged window;

an operating device fixed to said body for longitudinally moving said cable along the tubular guide member to cause opening and closing of said hinged window when operated; and a one-way braking mechanism incorporating with said operating device for braking the longitudinal movements of said cable induced by the opening and closing movements of said hinged window, while freely permitting the movements via the operating of the operating device.

* * * * *